US010012924B2

(12) United States Patent
Yoshidome et al.

(10) Patent No.: US 10,012,924 B2
(45) Date of Patent: Jul. 3, 2018

(54) ELECTROPHOTOGRAPHIC ELECTRO-CONDUCTIVE MEMBER HAVING A DUAL RUBBER ELASTIC LAYER, METHOD OF PRODUCING THE SAME, PROCESS CARTRIDGE, AND ELECTROPHOTOGRAPHIC APPARATUS

(71) Applicant: CANON KABUSHIKI KAISHA, Tokyo (JP)

(72) Inventors: Takeshi Yoshidome, Kitakyushu (JP); Saki Tominaga, Suntou-gun (JP); Yasuhiro Fushimoto, Kamakura (JP); Norifumi Muranaka, Yokohama (JP); Kazuhiro Yamauchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/285,262

(22) Filed: Oct. 4, 2016

(65) Prior Publication Data

US 2017/0102633 A1 Apr. 13, 2017

(30) Foreign Application Priority Data

Oct. 8, 2015 (JP) ..... 2015-200209

(51) Int. Cl.
*G03G 15/02* (2006.01)
*G03G 21/18* (2006.01)

(52) U.S. Cl.
CPC ..... *G03G 15/0233* (2013.01); *G03G 21/18* (2013.01); *G03G 21/1814* (2013.01)

(58) Field of Classification Search
CPC . G03G 15/0233; G03G 21/1814; G03G 21/18
USPC ..... 399/111
See application file for complete search history.

(56) References Cited

U.S. PATENT DOCUMENTS 6,044,243 A * 3/2000 Hara ..... G03G 15/162 399/302
2011/0013939 A1* 1/2011 Ono ..... G03G 15/0233 399/176

FOREIGN PATENT DOCUMENTS

JP 2008-256908 A 10/2008

* cited by examiner

*Primary Examiner* — Billy Lactaoen
(74) *Attorney, Agent, or Firm* — Canon U.S.A., Inc. IP Division

(57) ABSTRACT

An electrophotographic electro-conductive member comprising an electro-conductive mandrel and an electro-conductive elastic layer on the electro-conductive mandrel, wherein the electro-conductive elastic layer has an elastic coefficient of 1 MPa or more and 100 MPa or less, as well as a matrix containing first rubber and a plurality of electro-conductive domains dispersed in the matrix. Each of the electro-conductive domains contains an electro-conductive particle, and the electro-conductive elastic layer includes regions containing second rubber in the circumferences of the electro-conductive domains. The matrix has an elastic coefficient $R_1$, the regions containing second rubber have an elastic coefficient $R_2$, and the elastic coefficients $R_1$ and $R_2$ satisfy a relationship: $R_1<R_2$.

10 Claims, 3 Drawing Sheets

ELECTROPHOTOGRAPHIC ELECTRO-CONDUCTIVE MEMBER HAVING A DUAL RUBBER ELASTIC LAYER, METHOD OF PRODUCING THE SAME, PROCESS CARTRIDGE, AND ELECTROPHOTOGRAPHIC APPARATUS

BACKGROUND

Field of the Disclosure

The present disclosure relates to an electrophotographic electro-conductive member, a process cartridge, and an electrophotographic apparatus.

Description of the Related Art

In an electrophotographic apparatus, which is an image-forming apparatus employing an electrographic system, an electro-conductive member is applied to a variety of uses, for example, use as an electro-conductive roller, such as a charging roller, developing roller, or a transferring roller. These electro-conductive rollers are required to have an electric resistance value of $10^3$ to $10^{10}\Omega$ and are provided with elastic layers containing electro-conductive particles, such as carbon black, for adjusting the conductivity of the electro-conductive layers. The electric resistance value of electro-conductive particles readily varies depending on the dispersed state, and stabilization of the electric resistance value of an electro-conductive member may be difficult in some cases.

If an electro-conductive member is abutted against, for example, a photosensitive member in an electrophotographic apparatus, continuous and intermittent repeating compression is applied to the elastic layer. As a result, in some cases, the dispersed state of the electro-conductive particles, such as carbon black, changes to cause a change in the electric resistance value. Japanese Patent Laid-Open No. 2008-256908 discloses an electro-conductive member composed of polar rubber and carbon black dispersed therein at optimized DBP absorption amount, particle diameter, and amount for preventing the variation in the electric resistance value of the electro-conductive member.

One embodiment of the present disclosure is directed to providing an electro-conductive member for electrophotography which can prevent change in an electric resistance value even in long time use. Another embodiment of the present disclosure is directed to providing a process cartridge and an electrophotographic apparatus both of which can provide a high quality electrophotographic image for a long time.

SUMMARY

According to an embodiment of the present disclosure, there is provided an electrophotographic electro-conductive member comprising: an electro-conductive mandrel; and an electro-conductive elastic layer on the electro-conductive mandrel, wherein the electro-conductive elastic layer has an elastic coefficient of 1 MPa or more and 100 MPa or less; the electro-conductive elastic layer includes a matrix containing first rubber and a plurality of electro-conductive domains dispersed in the matrix; each of the electro-conductive domains contains an electro-conductive particle; the electro-conductive elastic layer includes regions containing second rubber in circumferences of the electro-conductive domains; and the matrix has an elastic coefficient $R_1$, and the regions containing second rubber have an elastic coefficient $R_2$, wherein the elastic coefficients $R_1$ and $R_2$ satisfy a relationship: $R_1<R_2$.

Another embodiment of the present disclosure provides a method of producing the electrophotographic electro-conductive member described above. The method includes:

(1) melting and kneading an electro-conductive elastic layer-forming rubber mixture of first rubber or a raw material of the first rubber and electro-conductive particles with a biaxial kneading extruder or a high shearing device equipped with a return screw;

(2) forming a layer of the molten and kneaded product prepared in step (1) on an electro-conductive mandrel; and (3) curing the layer of the molten and kneaded product.

Another embodiment of the present disclosure provides a process cartridge detachably attachable to the main body of an electrophotographic apparatus and including the electrophotographic electro-conductive member described above.

Another embodiment of the present disclosure provides an electrophotographic apparatus including the electrophotographic electro-conductive member.

Further features of the present disclosure will become apparent from the following description of exemplary embodiments with reference to the attached drawings.

DESCRIPTION OF THE EMBODIMENTS

Recently, electrophotographic apparatuses have been required to increase the speed and the lifetime. The present inventors have studied the electro-conductive member described in Japanese Patent Laid-Open No. 2008-256908 and have found that although carbon black is uniformly dispersed and the electric resistance value is well controlled, the reduction of the variation in the electric resistance value is still insufficient for using the electro-conductive member over a long time. Specifically, the use of the electro-conductive member according to the disclosure described in Japanese Patent Laid-Open No. 2008-256908 as the charging member of an electrophotographic apparatus employing a DC charging system, which charges a photosensitive member by applying only a DC voltage to the charging member, increased, the electric resistance value in some cases. As a result, the charged potential of the photosensitive member is unstable to cause a fine horizontal streak-like defect in electrophotographic images.

If the electro-conductive member according to the disclosure disclosed in Japanese Patent Laid-Open No. 2008-

256908 is used as the transferring member of an electrophotographic apparatus, application of a DC voltage for a long time increases the electric resistance value. An increase in the electric resistance value of the transferring member to be higher than a predetermined value may cause spot defects in the electrophotographic image. In particular, this phenomenon is significantly observed under an environment of a low temperature and a low humidity.

Accordingly, the present inventors have studied for obtaining an electrophotographic electro-conductive member of which the electric resistance value is prevented from changing even in use for a long time to prevent the charging performance from changing over time when used, for example, as a charging member, and have found that an electrophotographic electro-conductive member including an electro-conductive elastic layer having a specific structure can well satisfy the above-mentioned requires.

Figure 2:
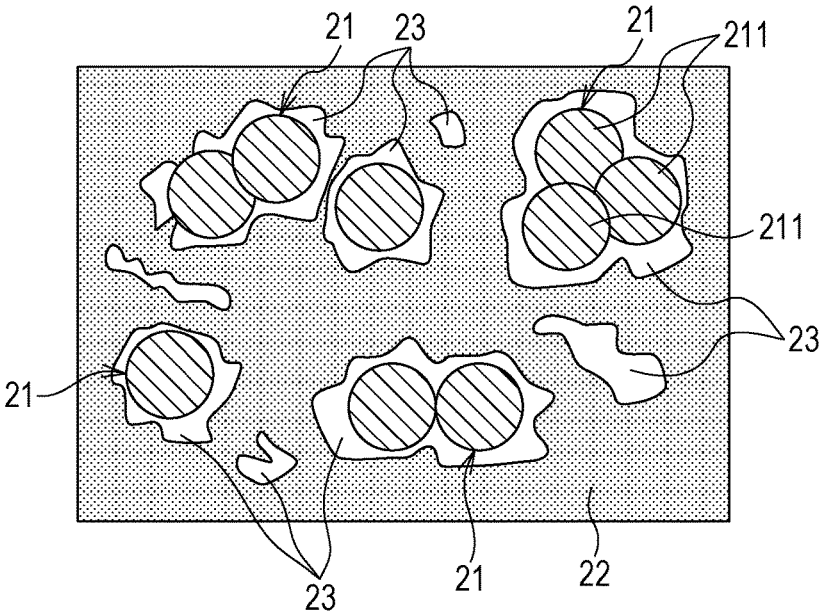
FIG. 2 is a model diagram illustrating a matrix containing first rubber and a dispersed state of electro-conductive domains containing electro-conductive particles and regions containing second rubber, in an electro-conductive layer according to the present disclosure.

FIG. 2 is a model diagram illustrating a matrix 22 containing first rubber and a dispersed state of electro-conductive domains 21 containing electro-conductive particles and regions 23 containing second rubber, in the electro-conductive elastic layer of the electrophotographic electro-conductive member according to an embodiment of the present disclosure. Such a structure of the electro-conductive member can prevent the occurrence of images with horizontal stripes or dots resulted from a change in the electric resistance value.

The present inventors have inferred main causes of the variation in the electric resistance value of the electro-conductive member as follows: In the case of an electro-conductive member abutting against a photosensitive member, the electro-conductive member is repeatedly mechanically compressed near the nip formed between the photosensitive member and the electro-conductive member. On this occasion, the dispersed state of the electro-conductive particles playing as electro-conductive paths in the rubber composition is destroyed by the mechanical stress. As a result, the network structure of the electro-conductive paths is changed to vary the electric resistance value. That is, the mobility of electro-conductive particles due to mechanical energy and the change of the dispersed state are probably main causes of the change in the electric resistance value.

Accordingly, the present inventors have diligently studied to prevent the phenomenon of the electro-conductive particles moving when mechanical energy is applied to the electro-conductive elastic layer over a long time, while maintaining the conductivity as far as possible, and have found that the electro-conductive domains are prevented from moving, when regions containing second rubber are arranged in the circumferences of the electro-conductive domains containing the electro-conductive particles and when the elastic coefficient $R_1$ of the matrix containing first rubber and the elastic coefficient $R_2$ of the regions containing second rubber satisfy a relationship: "$R_1<R_2$". That is, such a structure can reduce the time-dependent change in the electric resistance value even by repeating compression for a long time.

The present disclosure will now be described in detail. Hereinafter, the electrophotographic electro-conductive member will be described by means of a charging roller or a transferring roller, but the application of the electro-conductive member of the present disclosure is not limited thereto.

<Electro-Conductive Member>

Figure 1:
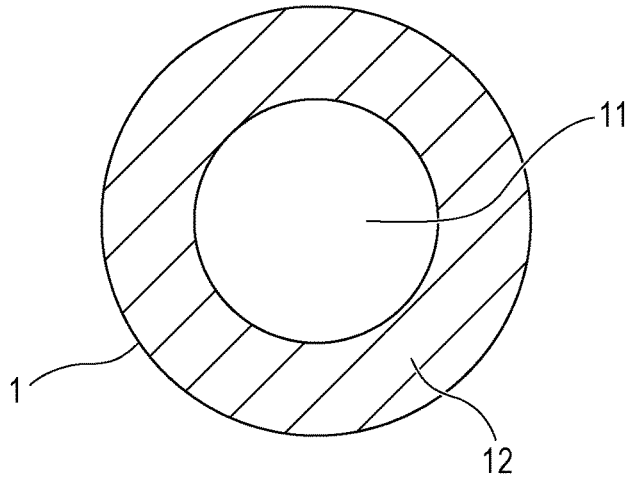
FIG. 1 is a diagram illustrating an example of the electrophotographic electro-conductive member according to the present disclosure.

As shown in the cross section of FIG. 1, the electrophotographic electro-conductive member 1 according to an embodiment of the present disclosure includes an electro-conductive elastic layer 12 of a rubber composition containing electro-conductive particles on an electro-conductive mandrel 12. Furthermore, another layer may be disposed on the electro-conductive elastic layer as needed.

<Electro-Conductive Mandrel>

The electro-conductive mandrel may be appropriately selected from those known in the field of electrophotographic electro-conductive member and is, for example, a cylinder made of a carbon steel alloy and having a surface plated with nickel to a thickness of about 5 μm.

<Electro-Conductive Elastic Layer>

The electro-conductive elastic layer has an elastic coefficient of 1 MPa or more and 100 MPa or less, which is a typical value of the rubber material used in the electro-conductive elastic layer described below. An electro-conductive elastic layer having an elastic coefficient within this range can readily provide a stable abutting state between the electrophotographic photosensitive member and the electro-conductive member.

FIG. 2 is a schematic diagram illustrating the structure of the electro-conductive elastic layer. The electro-conductive elastic layer according to an embodiment of the present disclosure includes a matrix 22 containing first rubber, a plurality of electro-conductive domains 21 dispersed in the matrix and containing electro-conductive particles 211, and regions 23 containing second rubber in the circumferences of the electro-conductive domains 21. The elastic coefficient $R_1$ of the matrix 22 and the elastic coefficient $R_2$ of the regions 23 containing second rubber satisfy the relationship: $R_1<R_2$. The regions 23 containing second rubber may exist not only in the circumferences of the electro-conductive domains 21 but also in the matrix 22 containing first rubber other than the circumferences of the electro-conductive domains 21 as shown in FIG. 2.

[Matrix Containing First Rubber]

The electro-conductive elastic layer includes a matrix containing first rubber. The first rubber may be any rubber and can be rubber known in the field of electrophotographic electro-conductive member, such as natural rubber, vulcanized natural rubber, and synthetic rubber. Examples of the synthetic rubber include styrene butadiene rubber (SER), acrylonitrile butadiene rubber (NBR), butadiene rubber (BR), and epichlorohydrin rubber. It has been confirmed that diene rubber containing a double bond in the main chain can readily form a sufficient quantity of second rubber having a high elastic coefficient during the kneading described below and can sufficiently prevent the electrification deterioration of the electro-conductive member. Accordingly, the synthetic rubber to be used can be styrene butadiene rubber (SBR), acrylonitrile butadiene rubber (NBR), or butadiene rubber (BR). It also has been confirmed that the acrylonitrile butadiene rubber (NBR) causes less thermal deterioration during the kneading. Accordingly, the rubber to be used can be NBR. Furthermore, the acrylonitrile butadiene rubber (NBR) can have a Mooney viscosity of 30 or more and 60 or less and a nitrile amount of 18% or more and 40% or less, from the viewpoint of workability.

Such rubber can contain additives that are generally used as compounding agents within a range that does not impair the advantageous effects of the present disclosure, such as a filler, a softener, a processing aid, a tackifier, an antitack agent, a dispersant, a foaming agent, and roughening particle.

[Electro-Conductive Domain]

The electro-conductive domain contains electro-conductive particles for providing conductivity to the electro-conductive member. Examples of the electro-conductive particles include the following electro-conductive particles:

fine particles or fibers of metals such as aluminum, palladium, iron, copper, and silver;

fine particles of metal oxides such as titanium oxide, tin oxide, and zinc oxide;

composite particles composed of the above-mentioned metal fine particles, fibers, or metal oxides subjected to surface treatment such as electrolytic treatment, spray coating, or mixing/shaking; and carbon blacks such as furnace black, thermal black, acetylene black, Ketjen black; and carbon powders such as polyacrylonitrile (PAN) carbon and Pitch carbon.

Examples of the furnace black include SAF-HS, SAF, ISAF-HS, ISAF, ISAF-LS, I-ISAF-HS, HAF-HS, HAF, HAF-LS, T-HS, T-NS, MAF, FEF, GPF, SRF-HS-HM, SRF-LM, ECF, and FEF-HS.

Examples of the thermal black include FT and MT.

These electro-conductive particles may be one kind of particles or a combination of different kinds of particles.

The content of the electro-conductive particles in the electro-conductive elastic layer can be about 3 to 90 parts by mass, in particular,  to  parts by mass, based on 100 parts by mass of the rubber.

The electro-conductive particles can have an average primary particle diameter of 5 nm or more and 60 nm or less, in particular,  nm or more and  nm or less. The average primary particle diameter of the electro-conductive particles is an arithmetic average particle diameter.

The electro-conductive domain can have a size of 0.005 μm (5 nm) to 1.000 μm, in particular,  μm to  μm. A size within this range can impart appropriate electrical resistance and flexibility to the electro-conductive elastic layer.

[Region Containing Second Rubber]

The region containing second rubber is a very important portion for reducing the mobility of the electro-conductive particles, while maintaining the rubber elasticity of the electro-conductive elastic layer. The elastic coefficient of the matrix containing first rubber and the elastic coefficient $R_2$ of the region containing second rubber must satisfy the relationship: "$R_1<R_2$". If the relationship is satisfied, the region containing second rubber can prevent the phenomenon of the electro-conductive domain moving. In particular, if the relationship, "$0.1 \leq R_1/R_2 \leq 0.5$", is satisfied, the effect of preventing the electro-conductive domain from moving can be further readily achieved, while maintaining the conductivity of the electro-conductive member.

[Measurement of Elastic Coefficient of Matrix Containing First Rubber and Region Containing Second Rubber]

Visualization and measurement of the elastic coefficients of the matrix containing first rubber and the region containing second rubber can be performed with a scanning probe microscope (SPM, another name: atomic force microscope (AFM)). The SPM detects various physical quantities acting between a sample and a cantilever that is equipped with a micro needle having a tip radius of 10 nm or less and has a scanning function and converts the physical properties at each point of measurement into contrast for visualization. The SPM can perform imaging the three-dimensional shape of the surface of a sample at a resolution of several nanometers simultaneous with the measurement of the physical quantities to verify the sample with the physical quantities and the shape information. The SPM that can be used in the measurement of the elastic coefficient in the present disclosure directly indents a cantilever having a known spring constant into a sample surface, draws a force curve from the forces applied to the cantilever and the deformation amounts of the sample, and determines the elastic coefficient based on the force curve. Furthermore, a mapping image of elastic coefficients and an image of the shape showing the dispersion of the electro-conductive particles and the rubber in the rubber composition can be obtained using the two-dimensional mapping function of the SPM.

The conditions for measurement will now be described. The sample used for measurement is cut out as an ultrathin piece having a thickness of about 2 μm from a roller-shaped electro-conductive elastic layer with a microtome at a cutting temperature of −100° C. This sample is subjected to SPM measurement under conditions of a spring constant of 0.315 N/m, an indentation load of 200 pN, a pixel number of 512×512, and a viewing field of 2.0×2.0 μm to prepare a mapping image of elastic coefficients and an image of the shape. In the measured images, electro-conductive domains dispersed in the matrix containing first rubber having a low elastic coefficient and regions containing second rubber having a high elastic coefficient existing in the circumstances of the electro-conductive domains are observed.

The matrix containing first rubber and the region containing second rubber can be discriminated from each other as follows. A histogram distribution of the elastic coefficient calculated for each pixel is acquired based on the mapping image of elastic coefficients obtained by SPM measurement. Subsequently, the histogram of the elastic coefficient derived from the rubber is subjected to waveform separation by a least squares method using a Gaussian function for peak separation. An elastic coefficient distribution derived from the first rubber and an elastic coefficient distribution derived from the second rubber can be thereby acquired. The median values of the thus-prepared elastic coefficient distributions of the first rubber and the second rubber are the elastic coefficient $R_1$ of the matrix and the elastic coefficient $R_2$ of the regions containing second rubber, respectively, in the present disclosure. Herein, the median value of an elastic coefficient distribution is the average μ in the Gaussian function used in the peak separation.

[Volume Resistivity and Other Factors]

The level of the electric resistance of the electro-conductive elastic layer is a volume resistivity of about $1\times10^3$ Ω·cm or more and $1\times10^9$ Ω·cm or less.

The electro-conductive elastic layer can have a hydrogen nuclear spin-spin relaxation time $T_2$ within a range of 200 μS or more and 500 μS or less at 50° C. A time $T_2$ within this range can provide advantages that the electro-conductive elastic layer of the electro-conductive member can stably abut against the electrophotographic photosensitive member and that the mobility of the electro-conductive particles can be reduced. The method of measuring the time $T_2$ will be described below.

[Method of Producing Electrophotographic Electro-Conductive Member]

An electrophotographic electro-conductive member including an electro-conductive elastic layer described above can be produced through the following steps:

(1) melting and kneading an electro-conductive elastic layer-forming rubber mixture containing unvulcanized first rubber (hereinafter, also referred to as "raw material of the first rubber") and electro-conductive particles with a biaxial kneading extruder or a high shearing device equipped with a return screw;

(2) forming a layer of the molten and kneaded product prepared in step (1) on an electro-conductive mandrel; and (3) curing the layer of the molten and kneaded product.

Herein, the region containing second rubber in the circumference of the electro-conductive domain can be constituted of, "polymer gel", rubber derived from the first rubber. The structure composed of an electro-conductive domain and a region containing second rubber constituted of polymer gel in the circumference of the electro-conductive domain can be formed through kneading of raw materials including first rubber and electro-conductive particles for forming an electro-conductive elastic layer by adjusting the type of the kneader, the shear velocity, and the kneading period of time.

The process of forming regions containing second rubber in the circumferences of electro-conductive domains will now be described.

An electro-conductive elastic layer-forming rubber mixture containing a raw material of first rubber and electro-conductive particles is molten and kneaded with a biaxial kneading extruder or a high shearing device equipped with a return screw. During the kneading, the molecular chain of the rubber is cut to generate an active radical. The generated active radical recombines with the molecular chain in the circumference or the electro-conductive particle, such as carbon black. The molecular chain recombined and complicatedly tangled on this occasion is the "polymer gel". That is, the generation of polymer gel needs a shear force sufficient for cutting molecular chain.

A larger shear force or a higher frequency of application of shear accelerates the cutting of rubber molecular chain to generate polymer gel that can reduce the mobility of the electro-conductive particles. In addition, in electro-conductive particles having larger specific surface areas and having surfaces containing functional groups, the molecular chains are readily bound to the surfaces of the electro-conductive particles to generate polymer gel preferentially in the circumference of the electro-conductive particles.

The present inventors have diligently studied and have revealed that the shear velocity can be within a range of 500 to 10000 $sec^{-1}$, in particular, 1000 to 10000 $sec^{-1}$, for efficiently generating polymer gel having a high elastic coefficient. Such a shear velocity cannot be achieved with a known pressure kneader or open roller for rubber.

The generation of the region containing second rubber significantly varies depending on the properties of the electro-conductive particles contained in the electro-conductive domain. Since the region containing second rubber can be readily generated in the circumferences of the electro-conductive particles having large specific surface areas and having surfaces containing functional groups, the electro-conductive particles can be carbon black. This is because that the regions containing second rubber are generated by physical and chemical absorption of the molecular chain of rubber to the electro-conductive particles during the melting and kneading of the matrix containing first rubber and the electro-conductive particles. Carbon black having a dibutylphthalate (DBP) absorption amount of 40 mL/100 g or more and 150 mL/100 g or less can be used. The DBP absorption amount is indirectly determined by measuring the structure of the primary particle of the carbon black. That is, regions containing second rubber can be readily generated using carbon black in an advanced structure having a DBP absorption amount within the above-mentioned range, by the same reasons described above. The DBP absorption amount of carbon black can be measured by the method described in JIS K 6217-4:2001.

Figure 3:
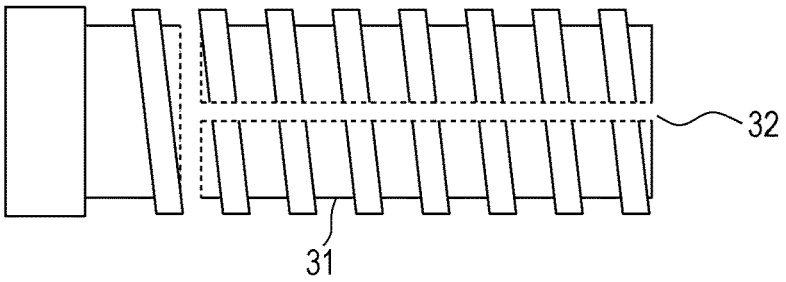
FIG. 3 is a diagram schematically illustrating a return screw used in the production of the electro-conductive elastic layer according to the present disclosure.

The shear processor for a rubber composition to generate a region containing second rubber in the circumference of an electro-conductive domain can be, for example, a high shearing device equipped with a return screw (such as HSE3000 min manufactured by Imoto machinery Co., Ltd. and NHSS8-28 manufactured by Niigata Machine Techno Co., Ltd.) or a biaxial kneading extruder (such as KZW15TW-4MG-NH (−6000) manufactured by Technovel Corporation). A high shearing device equipped with a return screw 31 having a return hole 32 therein, schematically shown in FIG. 3, can apply a shear velocity of 500 to 10000 $sec^{-1}$ to a rubber composition, whereas a biaxial kneading extruder applies a shear velocity of 500 to 1500 $sec^{-1}$ to a rubber composition. Accordingly, in this embodiment, a high shearing device equipped with a return screw, which can perform melting and kneading by shearing at a higher speed, can be used from the viewpoint of the ease of generating second rubber and an improvement in the dispersion of electro-conductive particles. That is, rubber and electro-conductive particles can be molten and kneaded with a kneader equipped with a return screw to form an electro-conductive elastic layer.

The use of a high shearing device allows application of a shear velocity of 500 to 10000 $sec^{-1}$, in particular, 1000 to 10000 $sec^{-1}$, to a rubber composition. As a result, the cutting and tangling of the molecular chain of rubber are accelerated during the process of melting and kneading of a rubber mixture to generate a raw material for second rubber. The region containing the raw material of second rubber generated in the melting and kneading process becomes a region having a structure of complicatedly tangled molecular chain and reduced molecular mobility after curing to show an elastic coefficient higher than that of the matrix containing first rubber. It has therefore been confirmed that the rubber composition including sufficiently generated second rubber having a high elastic coefficient reduces the mobility of the electro-conductive particles to prevent the electrification deterioration of the electro-conductive member. In addition, a higher shear velocity during melting and kneading can provide a shear force higher than the cohesive force of the electro-conductive particles and has an effect of uniformly dispersing the electro-conductive particles.

As described above, kneading of a rubber composition with a high shearing device can not only generate regions containing second rubber but also uniformly disperse electro-conductive particles. As a result, the electrification deterioration of the electro-conductive member is probably prevented to suppress the occurrence of horizontal streak images in electrophotographs.

The high shearing device equipped with a return screw includes a return hole 32 inside the screw and has a mechanism of allowing a rubber composition to reach the fore end portion of the screw and then return to the rear end portion of the screw through the return hole at the fore end of the screw during kneading. Accordingly, the rubber composition repeatedly passes through the return hole and receives shear associated with the extensional motion in the return hole. In addition, since it is possible to continuously retain the rubber composition in a high shear field, the rubber composition can receive a large shear force in a short time.

In the shearing of a rubber composition, the kneading can be accomplished within a short time by setting the hole diameter of the return hole to 2.0 to 5.0 mm for preventing the rubber composition from deteriorating by heat due to the shear. The present inventors have revealed that a diameter of the return hole of 0.5 mm causes insufficient circulation of rubber through the return hole, resulting in a difficulty in processing. The shear energy that is applied to a rubber composition, i.e., the shear heat, varies depending on the diameter of the return hole. Accordingly, the processing conditions can be 5 to 10 sec for a return hole diameter of 2.0 mm, 5 to 30 sec for a return diameter of 3.5 mm, and 5 to 60 sec for a return diameter of 5.0 mm.

[Method for Confirming the Presence of Region Containing Second Rubber (Polymer Gel)]

The presence of a region containing second rubber can be confirmed by, for example, acquisition of a mapping image of elastic coefficients with an SPM and measurement of spin-spin relaxation time $T_2$ by pulse NMR. The pulsed NMR measurement can confirm the molecular structure of the second rubber in the electro-conductive elastic layer, whereas the mapping image of elastic coefficients can visualize the dispersed state of the second rubber in a microregion.

The region containing second rubber reduces the mobility of the electro-conductive particles. The region containing second rubber is constituted of molecular chain of first rubber cut and tangled during the kneading of the first rubber and the electro-conductive particles. Accordingly, the molecular chain of the second rubber has molecular mobility lower than that the rubber present in the matrix containing first rubber. Consequently, the molecular structure of the second rubber predominantly affect the molecular mobility of the entire electro-conductive elastic layer according to the present disclosure. Therefore, the measurement of spin-spin relaxation time $T_2$ of the electro-conductive elastic layer can confirm the presence of a region containing second rubber and also quantitatively measure the molecular mobility of the region containing second rubber. The electro-conductive elastic layer according to the present disclosure can have a spin-spin relaxation time $T_2$ of 200 μS or more and 500 μS or less from the viewpoint of reducing the mobility of the electro-conductive particles by means of the second rubber and readily achieving a stable abutting state of the electro-conductive elastic layer against the photosensitive member.

The conditions for measurement by pulse NMR are as follows: An electro-conductive elastic layer is left to stand under an environment of a temperature of 23° C. and a relative humidity of 50% for 24 hours or more, and 0.5 g of the electro-conductive elastic layer is then scraped, is sealed in a measurement cell, and is subjected to measurement of the relaxation time $T_2$. The relaxation time $T_2$ is determined from the echo intensity obtained by a solid echo method using hydrogen nuclei as measurement nuclei in pulsed NMR measurement. The conditions for the measurement are a measurement frequency of 20 MHz, a 90° pulse width of 2.0 μsec, a pulse interval of 8 μsec, a temperature of 50° C., and a cumulative number of 128.

<Electrophotographic Apparatus>

Figure 4:
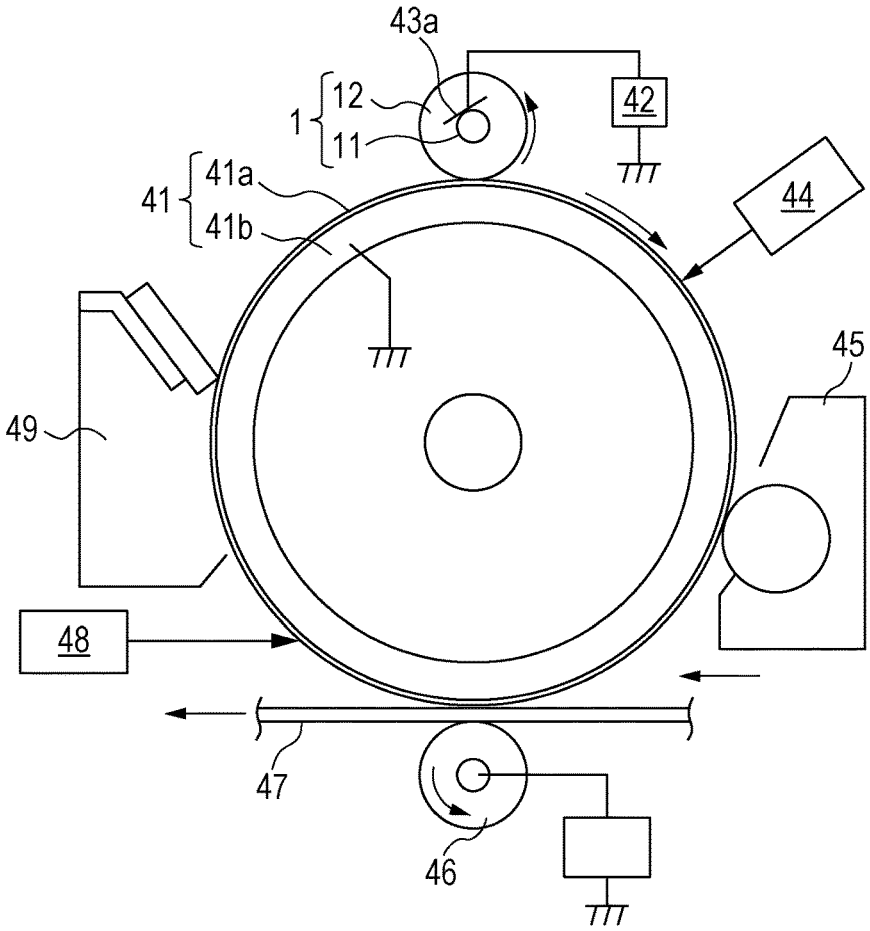
FIG. 4 is a configuration diagram illustrating an example of the electrophotographic apparatus including the electro-conductive member according to the present disclosure.

The electrophotographic apparatus according to an embodiment of the present disclosure includes an electrophotographic electro-conductive member. FIG. 4 schematically illustrates the configuration of an example of the electrophotographic apparatus. The photosensitive member 41 as the body to be electrified has a drum-like shape composed of an electro-conductive support 41*b* made of a material having conductivity, such as aluminum, and a photosensitive layer 41*a* laminated on the electro-conductive support 41*b*. The photosensitive member 41 is rotary-driven around the spindle 41*c* as the rotation center in the clockwise direction in the drawing at a predetermined circumferential velocity.

The both ends of the electro-conductive mandrel 11 of the charging roller 1 are pressed with a pressing means (not shown) so that the power supply 42 and the electro-conductive elastic layer applied with a direct current (DC) bias of rubbing electrode 43*a* are brought into contact with the photosensitive member via the electro-conductive mandrel. The charging roller is rotated following the rotation of the photosensitive member to uniformly charge (primary charging) the photosensitive member to predetermined polarity and potential.

Subsequently, an electrostatic latent image corresponding to the image information of a target is formed on the peripheral surface of the photosensitive member received exposure of the image information of the target (such as laser beam scanning exposure and slit exposure of an original image) from the exposure unit 44. The electrostatic latent image on the photosensitive member is formed into a toner image by adhesion of the toner supplied from the developing device 45. Subsequently, a transfer medium 47 is conveyed from a paper feeding unit (not shown) to the transfer part between the photosensitive member 41 and the transferring member 46 in synchronization with the rotation of the photosensitive member 41. The transferring member 46 applied with the polarity opposite that of the toner image is pressed to the transfer medium 47 from the back surface thereof to serially transfer the toner image onto the transfer medium 47.

The transfer medium 47 received the toner image is detached from the photosensitive member 41, is conveyed to a fixing unit (not shown) to fix the toner image, and is output as an image-formed product. In an electrophotographic apparatus forming images on both surfaces of a medium, the transfer medium 47 is conveyed by the conveying means to the charging roller for forming an image again.

The peripheral surface of the photosensitive member 41 after the image transfer receives pre-exposure by a pre-exposure unit 48 to remove the residual charge on the photosensitive member (neutralization). This pre-exposure unit 48 may be any known means, such as an LED chip array, a fuse lamp, a halogen lamp, and a fluorescent lamp. The peripheral surface of the neutralized photosensitive member 41 is subjected to removal of the adhering contaminants such as the remaining toner with the cleaning device 49 to clean the surface and is then repeatedly subjected to image formation.

In the electrophotographic apparatus, the charging roller 1 may be driven following the photosensitive member 41, may not rotate, or may actively rotate in the forward direction or reverse direction with respect to the surface moving direction of the photosensitive member 41 at a predetermined circumferential velocity. The exposure in the use of the electrophotographic apparatus as a copier may be performed with light reflected by or transmitted through the original or may be performed by reading and signalizing the original and, based on the signals, scanning laser beams, driving an LED array, or driving a liquid crystal shutter array.

Examples of the electrophotographic apparatus of the present disclosure include copiers, laser beam printers, LED printers, and electrophotographic application apparatuses such as electrophotoengraving systems.

<Process Cartridge>

Figure 5:
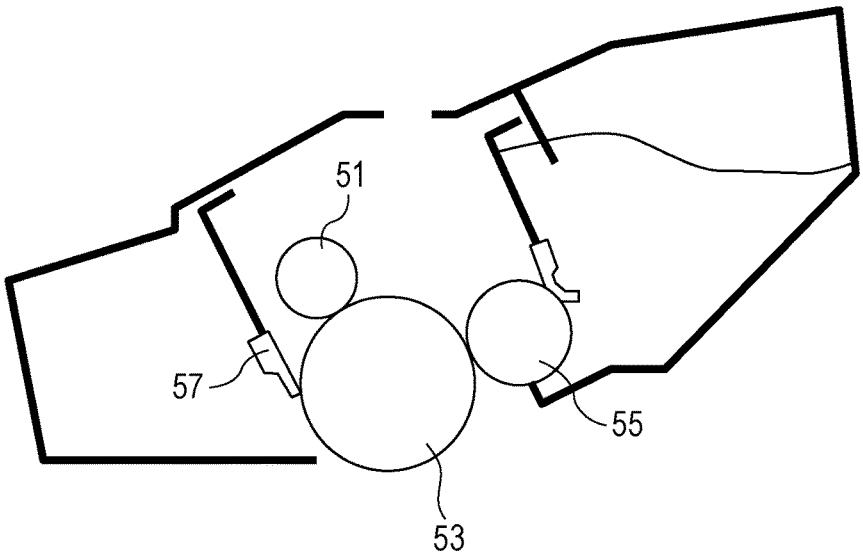
FIG. 5 is a diagram illustrating an example of the process cartridge according to the present disclosure.

The process cartridge according to an embodiment of the present disclosure includes the electro-conductive member described above and is detachably attachable to the main body of an electrophotographic apparatus. FIG. 5 illustrates the configuration of an example of the process cartridge. This process cartridge includes a roller-shaped electro-conductive member according to an embodiment of the present disclosure as the charging roller 51.

A drum-shaped electrophotographic photosensitive member (hereinafter, also referred to as "electrophotographic photosensitive drum") 53 is disposed so as to be capable of being charged with the charging roller 51. Specifically, the charging roller 51 is pressed to and is in contact with the electrophotographic photosensitive drum 53. The process cartridge further includes a developing roller 55 supplying a developer for developing the electrostatic latent image formed on the surface of the electrophotographic photosensitive drum 53 and a cleaning blade 57 removing the developer remaining on the peripheral surface of the electrophotographic photosensitive drum 53.

An embodiment of the present disclosure can provide an electro-conductive member of which the charging performance is prevented from changing even in use for a long time to allow stable formation of high-quality electrophotographic images. Another embodiment of the present disclosure can provide a process-cartridge and an electrophotographic apparatus that can form high-quality electrophotographic images.

EXAMPLES

The present disclosure will now be more specifically described by examples and comparative examples. In examples, paste rubber composition A refers to an unvulcanized rubber composition not containing a cross-linking agent and a vulcanization accelerator, and paste rubber composition B refers to an unvulcanized rubber composition containing a cross-linking agent and a vulcanization accelerator.

Example 1

1. Preparation of Paste Rubber Composition A

Four components shown in Table 1 other than acrylonitrile butadiene rubber were added to 100 parts by mass of the acrylonitrile butadiene rubber (NBR) (trade name: Nipol DN219, manufactured by Zeon Corporation) in the amounts shown in Table 1, and the mixture was mixed with a pressure kneader (TD6-15MDX: manufactured by Toshinsha Co., Ltd.) adjusted to 50° C. under conditions of a filling rate of 70%, a blade rotation speed of 30 rpm, a shear velocity of ** $sec^{-1}$, and mixing time of 16 minutes to give paste rubber composition A.

TABLE 1

| Material | parts by mass |
|---|---|
| Acrylonitrile butadiene rubber (NBR) (trade name: Nipol DN219, manufactured by Zeon Corporation) | 100 |
| Carbon black (trade name: Toka Black #3855, manufactured by Tokai Carbon Co., Ltd.) | 25 |
| Zinc oxide (trade name: Zinc Flower Grade 2, manufactured by Sakai Chemical Industry Co., Ltd.) | 8 |
| Zinc stearate (trade name: SZ-2000; manufactured by Sakai Chemical Industry Co., Ltd.) | 2 |
| Calcium carbonate (trade name: Nanox #30, manufactured by Maruo Calcium Co., Ltd.) | 30 |

2. Kneading of Paste Rubber Composition A with High Shearing Device

The paste rubber composition A was kneaded with a high shearing device equipped with a return screw (product name: "NHSS8-28", manufactured by Niigata Machine Techno Co., Ltd.). The return screw mounted on the device has a return hole of 2.0 mm. The paste rubber composition A was kneaded for 10 seconds with the device adjusted to a plasticization unit temperature of 100° C., a kneading unit temperature of 150° C., and a shear velocity of 6900 $sec^{-1}$ and was then discharged from the kneading unit to give a highly sheared rubber composition. On this occasion, the temperature of the kneading unit was controlled not to exceed 200° C. by reducing the shear heat with a cooling mechanism.

3. Preparation of Paste Rubber Composition B

The vulcanizing agent and the vulcanization accelerator shown in Table 2 were added to 100 parts by mass of the unvulcanized rubber composition kneaded with the high shearing device. Subsequently, the mixture was kneaded with a two-roll mill cooled to 25° C. for 10 minutes to give paste rubber composition B.

TABLE 2

| Material | parts by mass |
|---|---|
| Vulcanizing agent: sulfur (trade name: Sulfax PMC, manufactured Tsurumi Chemical Industry Co., Ltd.) | 1.8 |
| Vulcanization accelerator: tetrabenzylthiuram disulfide (TBzTD) (trade name: Perkacit TBzTD, manufactured by Performance Additives) | 6.8 |

4. Production of Electro-Conductive Roller

An electroless nickel plated free-machining steel round bar having a length of 252 mm and an outer diameter of 6 mm was prepared. An adhesive was applied to the whole circumference of the bar in a length range of 230 mm excluding an 11-mm area at each end of the bar. The adhesive used was of an electro-conductive hot-melt type. The application was performed with a roll coater. The bar applied with the adhesive was used as an electro-conductive mandrel metal core).

Subsequently, a cross-head extruder having an electro-conductive mandrel-supplying mechanism and an unvulcanized rubber roller-discharging mechanism was prepared. The cross head is provided with a die having an inner diameter of 12.5 mm. The temperatures of the extruder and the cross head were adjusted to 80° C., and the convey speed of the electro-conductive mandrel was adjusted to 60 mm/sec. Under these conditions, the paste rubber composition B was supplied from the kneading extruder, and a rubber layer of the paste rubber composition B was formed on the circumference surface of the electro-conductive mandrel in the cross head to give an unvulcanized rubber roller. Subsequently, the unvulcanized rubber roller was fed into a hot air vulcanization furnace of 170° C. and was heated for 60 minutes to give a vulcanized rubber roller. Both ends of the vulcanized rubber layer were then cut such that the rubber layer had a length of 230 mm. Lastly, the surface of the elastic layer was polished with a rotary grindstone. An electro-conductive roller having a diameter of 8.4 mm at each position 90 mm from the center toward both ends and a diameter of 8.5 mm at the center was thus prepared.

5. Evaluation of Electro-Conductive Roller

The electro-conductive roller was evaluated for the following items. The results of the evaluation are shown in Table 3.

5-1. Measurement of Elastic Coefficient of Electro-Conductive Roller

The positions for measuring elastic coefficient were three positions, a position 30 to 40 mm from one rubber end, a position 30 to 40 mm from the other rubber end, and a position at the center, in the axial direction (longitudinal direction) of the electro-conductive roller and three positions every 120° in the circumferential direction including each of the positions mentioned above, i.e., nine positions in total. The conditions for the measurements were a load of 300 mN and an indentation rate of the probe of 1 μm/10 sec.

The measurement was performed with a surface hardness measuring apparatus (trade name: Fischer Scope H100V, manufactured by Fischer Instruments K.K.). The probe used was a diamond Vickers indenter.

The electro-conductive roller was left to stand, before the measurement, under an environment of a temperature of 23° C. and a relative humidity of 50% for 24 hours or more, and the measurement was performed under the same environment.

5-2. Measurement of the Value of Current in Electro-Conductive Roller

Figure 6:
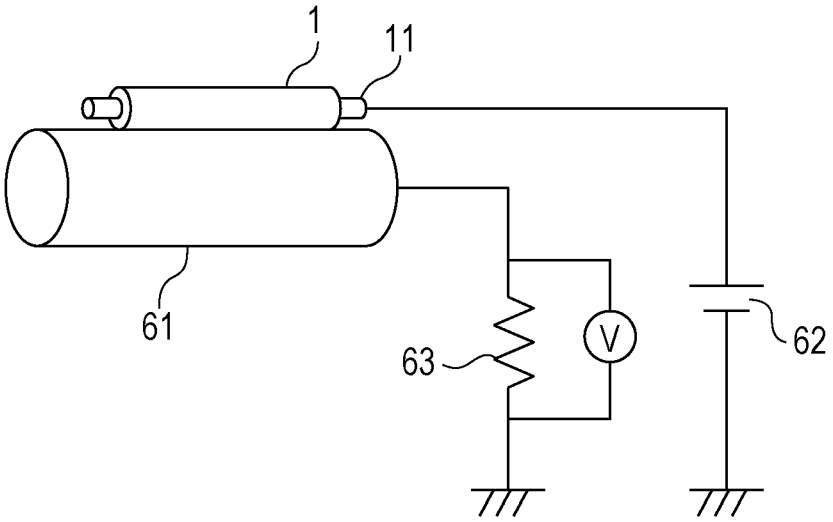
FIG. 6 is a configuration diagram illustrating an example of the electric resistance measuring apparatus for measuring the value of current flowing in the electro-conductive member according to the present disclosure.

The value of current flowing in the electro-conductive roller was measured with the electric resistance measuring apparatus schematically illustrated in FIG. 6. The both ends of the electro-conductive mandrel 11 of the electro-conductive roller were pressed with a pressing means (not shown) so that the electro-conductive roller is brought into pressure contact with the cylindrical aluminum drum 61 having a diameter of 30 mm, and the electro-conductive roller was rotated following the rotation of the aluminum drum. The voltage applied to the reference resistance 63 connected in series to the aluminum drum 61 was measured under application of a direct voltage to the electro-conductive mandrel of the electro-conductive roller with an external power source 62. The value of current flowing in the electro-conductive roller was calculated based on the electric resistance value of the reference resistance 63 and the voltage applied to the reference resistance 63.

The value of current flowing in the electro-conductive roller was measured under an environment of a temperature of 23° C. and a relative humidity of 50% by applying a direct voltage of 200 V between the electro-conductive mandrel and the aluminum drum for 2 seconds. On this occasion, the rotation speed of the aluminum drum was 30 rpm, and the electric resistance value of the reference resistance was 100Ω. Sampling of data was started 1 sec after the application of the voltage and was continued at a frequency of 20 Hz per second. The average of the data was defined as the value of current flowing in the electro-conductive roller.

5-3. Electrification Deterioration Test of Electro-Conductive Roller

The electrification deterioration of the electro-conductive roller was tested with the electric resistance measuring apparatus shown in FIG. 6. As in the measurement of the current value, the initial value of current flowing in the roller was measured by applying a direct voltage of 100 V between the electro-conductive mandrel and the aluminum drum for 2 seconds under an environment of a temperature of 23° C. and a relative humidity of 50%. On this occasion, the rotation speed of the aluminum drum was 30 rpm, and the electric resistance value of the reference resistance was 100Ω. Subsequently, a direct voltage of 100 V was applied between the electro-conductive mandrel and the aluminum drum for 10 minutes while the aluminum drum was rotated at 30 rpm. The value of current flowing in the electro-conductive roller was then measured again. The current retention rate (%) was calculated by dividing the current value $I_1$ after the electrification test by the initial current value $I_0$ and multiplying the quotient by 100.

5-4. Evaluation of Image of Electro-Conductive Roller

The produced electro-conductive roller was mounted on an electrophotographic process cartridge and was used as a charging roller. This process cartridge was mounted on an electrophotographic apparatus (trade name: LBP5050, manufactured by CANON KABUSHIKI KAISHA) that can output A4-size paper in the longitudinal direction, and electrophotographic images were formed. One sheet of an electrophotographic image, a halftone image (an image of lines of one-dot width drawn at two-dot intervals in the direction perpendicular to the rotational direction of the electrophotographic photosensitive member) formed on A4-size paper, was output. This image is referred to as "the 1st image". Subsequently, 2500 sheets of an electrophotographic image of alphabet letter "E" formed on A4-size paper at a print density of 1% were output. Subsequently, one sheet of an electrophotographic image, a halftone image formed on A4-size paper, was output. This image is referred to as "the 2501st image". All of the electrophotographic images were output under an environment of a temperature of 15° C. and a relative humidity of 10%. The 1st image and the 2501st image were visually observed for evaluating the presence of fine horizontal streaks, which may occur by an increase in the electric resistance value of the charging roller, and evaluating the degree of the fine horizontal streaks, based on the following criteria. The 2501st image was also evaluated for the presence of vertical streaks, which may occur by adhesion of, for example, toner to the surface of the charging roller, and the degree of the vertical streaks based on the following criteria.

Rank A: No occurrence of streaks was observed.

Rank B: Occurrence of streaks was slightly observed.

Rank C: Occurrence of streaks was observed.

Bank D: Occurrence of streaks was notably observed.

5-5. Measurement of Elastic Coefficient with SPM

The elastic coefficients of the matrix containing first rubber and the regions containing second rubber in the electro-conductive elastic layer were measured with a scanning probe microscope (SPM) that can measure the elastic coefficient from a force curve of all measurement points to perform two-dimensional mapping. The SPM (trade name: Dimension Icon, manufactured by Bruker Corporation) was used under conditions of a spring constant of 0.315 N/m, an indentation load of 200 pN, a pixel number of 512×512, and a viewing field of 1.2×1.2 μm. The sample used for the measurement was cut out as an ultrathin piece having a thickness of about 2 μm from the electro-conductive elastic layer of the electro-conductive roller with a microtome (trade name: Leica EM FCS, manufactured by Leica Microsystems K.K.) at a cutting temperature of −100° C. The elastic coefficient distribution derived from rubber obtained from the mapping image of elastic coefficients was subjected to waveform separation by a least squares method using a Gaussian function for peak separation to calculate the elastic coefficient $R_1$ of the matrix containing first rubber and the elastic coefficient $R_2$ of the regions containing second rubber. The regions containing second rubber were particularly formed in the circumferences of the electro-conductive domains and had a thickness of about 10 to 100 nm.

5-6. Measurement of Spin-Spin Relaxation Time $T_2$ by Pulse NMR

The spin-spin relaxation time $T_2$ of the electro-conductive elastic layer was measured with a pulse NMR apparatus (MU25A, manufactured by JEOL Ltd.). The electro-conductive elastic layer was left to stand under an environment of a temperature of 23° C. and a relative humidity of 50% for 24 hours or more, and 0.5 g of the electro-conductive elastic layer was then scraped, was sealed in a measurement cell, and was subjected to measurement of the relaxation time $T_2$. The relaxation time $T_2$ was determined from the echo intensity obtained by a solid echo method using hydrogen nuclei as measurement nuclei in a pulsed NMR measurement. The conditions for the measurement were a measurement frequency of 20 MHz, a 90° pulse width of 2.0 μsec, a pulse interval of 8 μsec, a temperature of 50° C., and a cumulative number of 128.

Examples 2 to 5, 8, and 9

Electro-conductive rollers were produced as in Example 1 except that the types and amounts of the carbon black or the Mooney viscosity and the nitrile amount of NBR used in Example 1 were changed to those shown in Table 3-1, and were evaluated. Table 3-1 also shows the average primary particle diameters of carbon black, absorption amount and blended amount of DBP, and Mooney viscosity and nitrile amount of NBR. The results of the evaluation of the electro-conductive rollers are shown in Table 3-2.

Examples 6 and 7

Electro-conductive rollers were produced as in Example 1 except that the carbon black used in Example 1 was changed to graphite or carbon nanotube in the amounts shown in Table 4-1, and were evaluated. The results of the evaluation are shown in Table 4-2.

TABLE 4-1

| | | Electro-conductive particles | parts by mass |
|---|---|---|---|
| Example | 6 | Graphite (trade name: UF-G10, manufactured by Showa Denko K.K.) | 45 |
| | 7 | Carbon nanotube (trade name: VGCF-H, manufactured by Showa Denko K.K.) | 3 |

TABLE 3-1

| | | Carbon black | Arithmetic average primary particle diameter (nm) | DBP absorption amount (mL/100 g) | parts by mass | NBR | Mooney viscosity (nitrile amount) | Conditions for shearing with high shearing device equipped with return screw: Return hole diameter (mm) | Shear velocity ($sec^{-1}$) | Shearing time (sec) |
|---|---|---|---|---|---|---|---|---|---|---|
| Example | 1 | Toka Black #3855 (manufactured by Tokai Carbon Co., Ltd.) | 28 | 120 | 25 | DN219 (manufactured by JSR Corp.) | 27 (33.5%) | 2 | 6900 | 10 |
| | 2 | Toka Black #7400 (manufactured by Tokai Carbon Co., Ltd.) | 28 | 73 | 60 | DN219 (manufactured by JSR Corp.) | 27 (33.5%) | 2 | 6900 | 10 |
| | 3 | #85 (manufactured by Mitsubishi Chemical Corp.) | 40 | 48 | 70 | DN219 (manufactured by JSR Corp.) | 27 (33.5%) | 2 | 6900 | 10 |
| | 4 | SUNBLACK720 (manufactured by Asahi Carbon Co., Ltd.) | 20 | 56 | 35 | DN219 (manufactured by JSR Corp.) | 27 (33.5%) | 2 | 6900 | 10 |
| | 5 | Printex25 (manufactured by Degussa AG) | 56 | 45 | 90 | DN219 (manufactured by JSR Corp.) | 27 (33.5%) | 2 | 6900 | 10 |
| | 8 | Toka Black #3855 (manufactured by Tokai Carbon Co., Ltd.) | 28 | 120 | 25 | DN401LL (manufactured by Zeon Corp.) | 32 (18%) | 2 | 6900 | 10 |
| | 9 | Toka Black #3855 (manufactured by Tokai Carbon Co., Ltd.) | 28 | 120 | 25 | N230S (manufactured by JSR Corp.) | 56 (35%) | 2 | 6900 | 10 |

TABLE 3-2

| | | Roller elastic coefficient (MPa) | $R_1/R_2$ | $T_2$ (μS) | Initial current value (μA) | Current retention rate (%) | Evaluation result of image: 1st image | 2501st image |
|---|---|---|---|---|---|---|---|---|
| Example | 1 | 56 | 0.11 | 350 | 5800 | 82% | A | A |
| | 2 | 62 | 0.40 | 290 | 3200 | 62 | A | B |
| | 3 | 84 | 0.41 | 240 | 3400 | 58 | A | B |
| | 4 | 43 | 0.25 | 340 | 7400 | 71 | A | A |
| | 5 | 98 | 0.44 | 210 | 900 | 54 | B | C |
| | 8 | 52 | 0.17 | 340 | 4900 | 78 | A | A |
| | 9 | 58 | 0.20 | 280 | 1300 | 73 | A | A |

TABLE 4-2

| | | Roller elastic coefficient (MPa) | $R_1/R_2$ | $T_2$ (μS) | Initial current value (μA) | Current retention rate (%) | Evaluation result of image 1st image | Evaluation result of image 2501st image |
|---|---|---|---|---|---|---|---|---|
| Example | 6 | 38 | 0.46 | 480 | 2200 | 52 | B | C |
| | 7 | 17 | 0.47 | 470 | 6300 | 50 | B | C |

Examples 10 to 14

Electro-conductive rollers were produced as in Example 1 except that the NBR used in Example 1 was changed to epichlorohydrin rubber, styrene butadiene rubber (SBR), or butadiene rubber (BR) as shown in Table 5, and were evaluated. The results of the evaluation are shown in Table 6.

TABLE 5

| | | Rubber material |
|---|---|---|
| Example | 10 | Epichlorohydrin rubber (trade name: Epichlomer CG102, manufactured by Daiso Co., Ltd.) |
| | 11 | Epichlorohydrin rubber (trade name: Epion-301, manufactured by Daiso Co., Ltd.) |
| | 12 | SBR (trade name: Tafuden 2003, manufactured by Asahi Kasei Corp.) |
| | 13 | SBR (trade name: Tafuden 1000, manufactured by Asahi Kasei Corp.) |
| | 14 | BR (trade name: BR51, manufactured by JSR Corp.) |

TABLE 6

| | | Roller elastic coefficient (MPa) | $R_1/R_2$ | $T_2$ (μS) | Initial current value (μA) | Current retention rate (%) | Evaluation result of image 1st image | Evaluation result of image 2501st image |
|---|---|---|---|---|---|---|---|---|
| Example | 10 | 2 | 0.47 | 490 | 3200 | 51 | B | C |
| | 11 | 8 | 0.49 | 475 | 4900 | 48 | B | C |
| | 12 | 32 | 0.38 | 390 | 1400 | 60 | B | B |
| | 13 | 28 | 0.31 | 410 | 1100 | 65 | B | B |
| | 14 | 24 | 0.35 | 330 | 2000 | 66 | B | B |

Examples 15 to 21

Electro-conductive rollers were produced as in Example 1 except that the conditions for shearing in preparation of paste rubber composition A were changed to the shearing conditions shown in Table 7-1, and were evaluated. The results of the evaluation are shown in Table 7-2.

TABLE 7-1

| | | Conditions for shearing with high shearing device equipped with return screw: Return hole diameter (mm) | Shear velocity ($sec^{-1}$) | Shearing time (sec) |
|---|---|---|---|---|
| Example | 15 | 2 | 6900 | 5 |
| | 16 | 3.5 | 1280 | 5 |

TABLE 7-1-continued

| | | Conditions for shearing with high shearing device equipped with return screw: Return hole diameter (mm) | Shear velocity ($sec^{-1}$) | Shearing time (sec) |
|---|---|---|---|---|
| | 17 | 3.5 | 1280 | 15 |
| | 18 | 3.5 | 1280 | 30 |
| | 19 | 5 | 800 | 5 |
| | 20 | 5 | 800 | 30 |
| | 21 | 5 | 800 | 60 |

TABLE 7-2

| | | Roller elastic coefficient (MPa) | $R_1/R_2$ | $T_2$ (μS) | Initial current value (μA) | Current retention rate (%) | Evaluation result of image 1st image | Evaluation result of image 2501st image |
|---|---|---|---|---|---|---|---|---|
| Example | 15 | 48 | 0.16 | 370 | 11000 | 75 | A | A |
| | 16 | 25 | 0.31 | 450 | 19000 | 64 | B | B |
| | 17 | 28 | 0.22 | 410 | 12000 | 70 | A | B |
| | 18 | 42 | 0.17 | 390 | 3200 | 74 | A | A |
| | 19 | 19 | 0.44 | 480 | 27000 | 55 | A | C |
| | 20 | 22 | 0.38 | 460 | 22000 | 60 | A | C |
| | 21 | 26 | 0.30 | 440 | 16000 | 67 | A | B |

Examples 22 to 26

Paste rubber composition A was prepared as in Example 1 except that shearing was performed with a biaxial kneader (product name: "KZW15TW-4MG-NH (−6000)", manufactured by Technovel Corporation) at a shear velocity shown in Table 8-1, and paste rubber composition B was prepared as in Example 1 using the thus-prepared paste rubber composition A. Electro-conductive rollers were produced as in Example 1 except that the thus-prepared paste rubber composition B was used, and were evaluated. The results of the evaluation are shown in Table 8-2.

TABLE 8-1

| | | Conditions for shearing with biaxial kneading extruder Shear velocity ($sec^{-1}$) |
|---|---|---|
| Example | 22 | 500 |
| | 23 | 600 |
| | 24 | 800 |
| | 25 | 950 |
| | 26 | 1100 |

TABLE 8-2

| | | Roller elastic coefficient (MPa) | $R_1/R_2$ | $T_2$ (μS) | Initial current value (μA) | Current retention rate (%) | Evaluation result of image 1st image | Evaluation result of image 2501st image |
|---|---|---|---|---|---|---|---|---|
| Example | 22 | 16 | 0.88 | 495 | 48000 | 48 | A | C |
| | 23 | 18 | 0.62 | 480 | 42000 | 53 | A | C |
| | 24 | 22 | 0.4 | 450 | 32000 | 61 | A | C |
| | 25 | 42 | 0.23 | 380 | 17000 | 69 | A | C |
| | 26 | 62 | 0.19 | 330 | 9900 | 73 | B | B |

Comparative Examples 1 and 2

Electro-conductive rollers were produced as in Example 1 except that the shear velocity and kneading time conditions in the kneading of paste rubber composition A in Example 1 were changed to those shown in Table 9-1 and that the kneading step with a high shearing device was not performed, and were evaluated as in Example 1. The results of the evaluation are shown in Table 9-2.

In the electro-conductive roller according to Comparative Example 1, no regions containing second rubber were observed in the measurement with an SPM. In the electro-conductive roller according to Comparative Example 2, the electro-conductive elastic layer was deteriorated during the processing, and therefore evaluation as an electro-conductive roller was not performed.

TABLE 9-1

| | | Conditions for shearing with pressure kneader Shear velocity ($sec^{-1}$) | Time (min) |
|---|---|---|---|
| Comparative | 1 | 250 | 16 |
| Example | 2 | 150 | 120 |

TABLE 9-2

| | | Roller elastic coefficient (MPa) | $R_1/R_2$ | $T_2$ (μS) | Initial current value (μA) | Current retention rate (%) | Evaluation result of image 1st image | 2501st image |
|---|---|---|---|---|---|---|---|---|
| Comparative Example | 1 | 9 | — | 530 | 42000 | 31 | A | D |
| | 2 | 120 | 0.88 | 180 | — | — | — | — |

Comparative Examples 3 and 4

Electro-conductive rollers were produced as in Example 1 except that the return hole diameter, the shear velocity, and the shearing time in the kneading with a high shearing device for preparing paste rubber composition A in Example 1 were set to those shown in Table 10-1, and were evaluated as in Example 1. The results of the evaluation are shown in Table 10-2.

In the electro-conductive roller according to Comparative Example 3, no second rubber was observed by the measurement with an SPM. In the electro-conductive roller according to Comparative Example 4, the electro-conductive elastic layer was deteriorated during the processing, and therefore evaluation as an electro-conductive roller was not performed.

TABLE 10-1

| | | Conditions for shearing with high shearing device equipped with return screw: Return hole diameter (mm) | Shear velocity ($sec^{-1}$) | Shearing time (sec) |
|---|---|---|---|---|
| Comparative Example | 3 | 10 | 10 | 10 |
| | 4 | 0.5 | 440000 | 10 |

TABLE 10-2

| | | Roller elastic coefficient (MPa) | $R_1/R_2$ | $T_2$ (μS) | Initial current value (μA) | Current retention rate (%) | Evaluation result of image 1st image | 2501st image |
|---|---|---|---|---|---|---|---|---|
| Comparative Example | 3 | 12 | — | 540 | 39000 | 28 | A | D |
| | 4 | 180 | 0.85 | 140 | — | — | — | — |

Example 27

1. Production of Electro-Conductive Roller

An electro-conductive roller was produced as in Example 1 except that the materials kneaded for preparing paste rubber composition A were those shown in Table 11, that the materials kneaded for preparing paste rubber composition B were those shown in Table 12, and that the outer diameter of the electro-conductive member was 12.5 mm.

TABLE 11

| Material | parts by mass |
|---|---|
| Acrylonitrile butadiene rubber (NBR) (trade name: Nipol DN219, manufactured by Zeon Corp.) | 100 |
| Carbon black (trade name: Toka Black #3855, manufactured by Tokai Carbon Co., Ltd.) | 10 |

TABLE 11-continued

| Material | parts by mass |
|---|---|
| Zinc oxide (trade name: Zinc Flower Grade 2, manufactured by Sakai Chemical Industry Co., Ltd.) | 8 |
| Zinc stearate (trade name: SZ-2000, manufactured by Sakai Chemical Industry Co., Ltd.) | 2 |
| Calcium carbonate (trade name: Nanox #30, manufactured by Maruo Calcium Co., Ltd.) | 30 |

TABLE 12

| Material | parts by mass |
|---|---|
| Kneaded paste rubber composition A | 100 |
| Vulcanizing agent: sulfur (trade name: Sulfax PMC, manufactured Tsurumi Chemical Industry Co., Ltd.) | 1.8 |
| Vulcanization accelerator: tetrabenzylthiuram disulfide (TBzTD) (trade name: Perkacit TBzTD, manufactured by Performance Additives) | 6.8 |
| Foaming agent: azodicarbonamide (trade name: Vinyfor AC#LQ, manufactured by Eiwa Chemical Ind. Co., Ltd.) | 3 |
| Foaming auxiliary: urea (trade name: Cellpaste A, manufactured by Eiwa Chemical Ind. Co., Ltd.) | 2 |

2. Evaluation of Electro-Conductive Roller

This electro-conductive roller was used as a transferring roller and was subjected to the following evaluations 2-1 to 2-3. The evaluations, 5-1 (Measurement of elastic coefficient of electro-conductive roller), 5-5 (Measurement of elastic coefficient with SPM), and 5-6 (Measurement of spin-spin relaxation time $T_2$ by pulse NMR), in Example 1 were also performed. The results of the evaluation are shown in Table 15.

2-1. Measurement of Electric Resistance of Electro-Conductive Roller

The transferring roller was brought into pressure contact with an aluminum drum having an outer diameter of 30 mm by applying a load of 4.9 N to each of the ends of the electro-conductive mandrel of the transferring roller. A voltage of 1000 V was applied between the electro-conductive mandrel and the aluminum drum while rotating the drum at 0.5 Hz, and the current value was measured under an environment of a temperature of 23° C. and a relative humidity of 50% (N/N environment). The electric resistance value was calculated in accordance with Ohm's law and was converted logarithmically to give the resistance Log R of the electro-conductive roller.

2-2. Electrification Deterioration Test of Electro-Conductive Roller

The value of current flowing in the electro-conductive roller was measured under an environment of a temperature of 23° C. and a relative humidity of 50% (N/N environment) by the same resistance measuring method described above. The electric resistance value was calculated in accordance with Ohm's law and was converted logarithmically to give the resistance Log $R_{10}$ of the roller before the electrification deterioration test. Subsequently, the electro-conductive roller was brought into pressure contact pressure contact with an aluminum drum having an outer diameter of 30 mm by applying a load of 4.9 N to each of the ends of the electro-conductive mandrel of the electro-conductive roller. A constant current of 80 μA was applied between the electro-conductive mandrel and the aluminum drum for 25 hours while rotating the drum at 0.2 Hz. Subsequently, the current value was measured again under an environment of a temperature of 23° C. and a relative humidity of 50% (N/N environment). The electric resistance value was calculated in accordance with Ohm's law and was converted logarithmically to give the resistance Log $R_{11}$ of the roller after the electrification deterioration test. Herein, the resistance Log $R_{10}$ of the roller before the electrification deterioration test was subtracted from the electric resistance value Log $R_{11}$ after the electrification deterioration test to give a resistance variation digit after the electrification deterioration. A smaller resistance variation digit means better electrification durability of the electro-conductive roller.

2-3. Evaluation of Image of Electro-Conductive Roller

The electro-conductive roller after the electrification deterioration test was mounted on an electrophotographic process cartridge and was used as a transferring roller. This process cartridge was mounted on an electrophotographic apparatus (trade name: LBP6300, manufactured by CANON KABUSHIKI KAISHA) that can output A4-size paper, and electrophotographic images were formed. One sheet of an electrophotographic image, a halftone image (an image of lines of one-dot width drawn at two-dot intervals in the direction perpendicular to the rotational direction of the electrophotographic photosensitive member) formed on A4-size paper, was output. The electrophotographic image was output under an environment of a temperature of 15° C. and a relative humidity of 10%. The image was visually observed for evaluating the presence of dots in the image, which may occur by an increase in the electric resistance value of the transferring roller, and evaluating the degree of the dots, based on the following criteria.

Rank A: No occurrence of dots was observed.

Rank B: Occurrence of dots was slightly observed.

Rank C: Occurrence of dots was observed.

Rank. D: Occurrence of dots was notably observed.

Example 28

An electro-conductive roller was produced as in Example 27 except that the conditions for shearing in preparation of paste rubber composition A were changed to the conditions shown in Table 13, and was evaluated.

TABLE 13

| | Conditions for shearing with high shearing device equipped with return screw | | |
|---|---|---|---|
| | Return hole diameter (mm) | Shear velocity ($sec^{-1}$) | Shearing time (sec) |
| Example 27 | 2 | 6900 | 10 |
| Example 28 | 5 | 800 | 30 |

Example 29

Paste rubber composition A was prepared as in Example 27 except that shearing was performed, with a biaxial kneader (product name: "KZW15TW-4MG-NH (−6000)", manufactured by Technovel Corporation) at a shear velocity shown in Table 14. Paste rubber composition B was prepared as in Example 27 using the thus-prepared paste rubber composition A. An electro-conductive roller was produced as in Example 27 except that the thus-prepared paste rubber composition B was used, and was evaluated.

TABLE 14

| | Conditions for shearing with biaxial kneading extruder Shear velocity ($sec^{-1}$) |
|---|---|
| Example 29 | 1100 |

The results of evaluation of the electro-conductive rollers according to Examples 27 to 29 are shown in Table 15.

TABLE 15

| | Roller elastic coefficient (MPa) | $R_1/R_2$ | $T_2$ (μS) | Resistance variation digit | Evaluation result of image |
|---|---|---|---|---|---|
| Example 27 | 28 | 0.21 | 390 | 0.05 | A |
| Example 28 | 11 | 0.49 | 490 | 0.15 | A |
| Example 29 | 31 | 0.35 | 360 | 0.18 | B |

While the present disclosure has been described with reference to exemplary embodiments, it is to be understood that the disclosure is not limited to the disclosed, exemplary embodiments. The scope of the following claims is to be accorded the broadest interpretation so as to encompass all such modifications and equivalent structures and functions.

This application claims the benefit of Japanese Patent Application No. 2013-200209, filed Oct. 8, 2015, which is hereby incorporated by reference herein in its entirety.

What is claimed is:

1. An electrophotographic electro-conductive member comprising:

an electro-conductive mandrel; and an electro-conductive elastic layer on the electro-conductive mandrel, wherein the electro-conductive elastic layer has an elastic coefficient of 1 MPa or more and 100 MPa or less;

the electro-conductive elastic layer includes a matrix containing first rubber and a plurality of electro-conductive domains dispersed in the matrix;

each of the electro-conductive domains contains an electro-conductive particle;

the electro-conductive elastic layer includes regions containing second rubber in circumferences of the electro-conductive domains, the second rubber being a polymer gel derived from the first rubber; and the matrix has an elastic coefficient $R_1$, and the regions containing second rubber have an elastic coefficient $R_2$, wherein the elastic coefficients $R_1$ and $R_2$ satisfy a relationship: $R_1<R_2$, wherein the elastic coefficients R1 and R2 are obtained from a mapping image of a measurement sample sampled from the electro-conductive elastic layer, the mapping image being obtained by measuring the measurement sample with a scanning probe microscope under condition of a spring constant of 0.315 N/m, an indentation load of 200 pN, a pixel number of 512×512, and a viewing field of 2.0×2.0 μm.

2. The electrophotographic electro-conductive member according to claim 1, wherein the electro-conductive elastic layer has a hydrogen nuclear spin-spin relaxation time within a range of 200 μS or more and 500 μS or less at 50° C.

3. The electrophotographic electro-conductive member according to claim 1, wherein the electro-conductive particle is carbon black.

4. The electrophotographic electro-conductive member according to claim 1, wherein the first rubber contained in the electro-conductive elastic layer is nitrile butadiene rubber or styrene butadiene rubber.

5. A method of producing an electrophotographic electro-conductive member comprising an electro-conductive mandrel and an electro-conductive elastic layer on the electro-conductive mandrel, wherein the electro-conductive elastic layer has an elastic coefficient of 1 MPa or more and 100 MPa or less;

the electro-conductive elastic layer includes a matrix containing first rubber and electro-conductive domains dispersed in the matrix;

each of the electro-conductive domains contains an electro-conductive particle;

the electro-conductive elastic layer includes regions containing second rubber in circumferences of the electro-conductive domains; and the matrix has an elastic coefficient $R_1$, and the regions containing second rubber have an elastic coefficient $R_2$, wherein the elastic coefficients $R_1$ and $R_2$ satisfy a relationship: $R_1<R_2$, and the method comprising:

(1) melting and kneading an electro-conductive elastic layer-forming rubber mixture containing first rubber or a raw material of the first rubber and an electro-conductive particle with a biaxial kneading extruder or a high shearing device equipped with a return screw, to obtain a rubber composition including a matrix containing the first rubber or the raw material of the first rubber, electro-conductive domains each of which contains an electro-conductive particles, and regions in circumferences of the electro-conductive domains, the regions containing second rubber which is a polymer gel derived from the first rubber or the raw material of the first rubber;

(2) forming a layer of the rubber composition obtained in the step (1) on an electro-conductive mandrel; and (3) curing the layer of the rubber composition to obtain the electrophotographic electro-conductive member.

6. The method according to claim 5, wherein the rubber mixture is molten and kneaded with a biaxial kneading extruder, and the biaxial kneading extruder applies a shear velocity of 500 to 1500 $sec^{-1}$ to the rubber mixture.

7. The method according to claim 5, wherein the rubber mixture is molten and kneaded with a high shearing device equipped with a return screw, and the high shearing device equipped with a return screw applies a shear velocity of 500 to 10000 $sec^{-1}$ to the rubber mixture.

8. The method according to claim 7, wherein a shear velocity of 1000 to 10000 $sec^{-1}$ is applied to the rubber mixture.

9. A process cartridge detachably attachable to a main body of an electrophotographic apparatus, comprising:

an electrophotographic photosensitive member; and a charging member arranged so as to be capable of charging the electrophotographic photosensitive member, wherein the charging member is an electrophotographic electro-conductive member;

the electrophotographic electro-conductive member includes an electro-conductive mandrel and an electro-conductive elastic layer on the electro-conductive mandrel;

the electro-conductive elastic layer has an elastic coefficient of 1 MPa or more and 100 MPa or less;

the electro-conductive elastic layer includes a matrix containing first rubber and a plurality of electro-conductive domains dispersed in the matrix;

each of the electro-conductive domains contains an electro-conductive particle;

the electro-conductive elastic layer includes regions containing second rubber in circumferences of the electro-conductive domains, the second rubber being a polymer gel derived from the first rubber; and the matrix has an elastic coefficient $R_1$, and the regions containing second rubber have an elastic coefficient $R_2$, wherein the elastic coefficients $R_1$ and $R_2$ satisfy a relationship: $R_1<R_2$, wherein the elastic coefficients R1 and R2 are obtained from a mapping image of a measurement sample sampled from the electro-conductive elastic layer, the mapping image being obtained by measuring the measurement sample with a scanning probe microscope under condition of a spring constant of 0.315 N/m, an indentation load of 200 pN, a pixel number of 512×512, and a viewing field of 2.0×2.0 μm.

10. An electrophotographic apparatus comprising an electrophotographic electro-conductive member, wherein the electrophotographic electro-conductive member includes an electro-conductive mandrel and an electro-conductive elastic layer on the electro-conductive mandrel;

the electro-conductive elastic layer has an elastic coefficient of 1 MPa or more and 100 MPa or less;

the electro-conductive elastic layer includes a matrix containing first rubber and a plurality of electro-conductive domains dispersed in the matrix;

each of the electro-conductive domains contains an electro-conductive particle;

the electro-conductive elastic layer includes regions containing second rubber in circumferences of the electro-conductive domains, the second rubber being a polymer gel derived from the first rubber; and the matrix has an elastic coefficient $R_1$, and the regions containing second rubber have an elastic coefficient $R_2$, wherein the elastic coefficients $R_1$ and $R_2$ satisfy a relationship: $R_1<R_2$, wherein the elastic coefficients R1 and R2 are obtained from a mapping image of a measurement sample sampled from the electro-conductive elastic layer, the mapping image being obtained by measuring the measurement sample with a scanning probe microscope under condition of a spring constant of 0.315 N/m, an indentation load of 200 pN, a pixel number of 512×512, and a viewing field of 2.0×2.0 μm.

* * * * *